US010881175B2

(12) United States Patent
Demeo

(10) Patent No.: US 10,881,175 B2
(45) Date of Patent: Jan. 5, 2021

(54) WALKING CANE

(71) Applicant: Emilia M. Demeo, Woodbridge, VA (US)

(72) Inventor: Palmer Christopher Demeo, Woodbridge, VA (US)

( * ) Notice: Subject to any disclaimer, the term of this patent is extended or adjusted under 35 U.S.C. 154(b) by 0 days.

(21) Appl. No.: 16/873,698

(22) Filed: Jun. 3, 2020

(65) Prior Publication Data

US 2020/0352289 A1 Nov. 12, 2020

(51) Int. Cl.
*A45B 9/02* (2006.01)
*A45B 9/00* (2006.01)

(52) U.S. Cl.
CPC ..... *A45B 9/02* (2013.01); *A45B 2009/007* (2013.01)

(58) Field of Classification Search
CPC ..... A45B 9/02; A45B 2009/005
See application file for complete search history.

(56) References Cited

U.S. PATENT DOCUMENTS 2,388,778 A * 11/1945 Wheeler ..... A61H 3/02 135/68
4,787,405 A * 11/1988 Karwoski ..... A45B 3/00 135/65
5,318,058 A * 6/1994 Zimmerman ..... A61H 3/02 135/68
5,495,867 A 3/1996 Block
5,924,434 A * 7/1999 Cato, III ..... A61H 3/02 135/68
6,378,541 B1 * 4/2002 Matthews ..... A61H 3/02 135/68
6,834,660 B1 * 12/2004 Van Wart, Jr. ..... A61H 3/02 135/72
D539,523 S * 4/2007 Wu ..... D3/7
7,610,926 B2 * 11/2009 Adams ..... A45B 9/04 135/71
9,561,150 B2 * 2/2017 Dickerson, II ..... A45B 7/005
9,877,888 B1 * 1/2018 Sosebee ..... A45B 9/02
2007/0256718 A1 * 11/2007 Diaz ..... A61H 3/02 135/72
2016/0316869 A1 * 11/2016 Byrd ..... A45B 9/04

FOREIGN PATENT DOCUMENTS

CN 20-2012-0001356 2/2012

* cited by examiner

*Primary Examiner* — Noah Chandler Hawk

(57) ABSTRACT

This invention is for a walking cane having three handles to assist a disabled person after an accidental fall to the ground to enable him or her to rise using the three handles of the cane in an erect or upright position after he or she has fallen and to assist him or her to continue walking or to seek additional assistance if necessary.

16 Claims, 3 Drawing Sheets

WALKING CANE

BACKGROUND OF THE INVENTION

I. Field of the Invention

This invention relates to a walking cane having lower side handles extending from the main elongated shaft of the walking cane which handles may be used by an invalid person to assist said person to raise said person from a fallen ground position to an upright position.

Description of the Related Art

There are two prior art patents which disclose a walking cane to assist an invalid person to stand in an upright position using a walking cane. The first patent is U.S. Pat. No. 5,495,867. The second patent is a Chinese patent number 20-2012-0001356.

Each of these patents discloses a walking cane with a curved extension positioned at a spaced distance below the customary upper handle used by the invalid person. In particular, the U.S. patent discloses the use of a walking cane with a handle below the customary upper handle which lower handle is used by the invalid person in helping that invalid person to rise from a chair. The Chinese patent discloses a walking cane with a handle below the customary upper handle to help the invalid person to rise from a sitting position on the ground to an upright position as shown in FIGS. A, B and C of this patent. However, none of these two prior art patents discloses a walking cane to assist an invalid person to rise from a fallen ground position to an upright position in order to continue walking or call someone for further help if that invalid person is injured. However, the walking cane of this invention solves this latter problem.

SUMMARY OF THE INVENTION

The present invention is directed to a walking cane which has a twofold purpose for an invalid person (1) to assist the invalid person to continue walking and (2) to assist an invalid person to upright himself/herself from a ground position after an accidental fall or a fall due to a physical/mental condition such as neuropathy and to continue his/her walk with the aid of his/her walking cane or to seek further help due to some physical injury to his/her body. The walking cane of his invention has a unique structure including two spaced handles lower than the customary upper handle which the invalid person normally grasps with his/her hand. Each of the lower handles if joined to the elongated shaft by a goose-neck connection between the respective handle and the elongated shaft. There are two embodiments of this invention. One walking cane for use with a right-handed invalid person and another walking cane for use with a left-handed invalid person. Each of these walking canes has a customary upper handle at the upper end of an elongated shaft and a four-pronged support footage at the lower end of the elongated shaft. Further, each of these walking canes has a first handle spaced below the customary upper handle and a second spaced handle spaced below the first handle and above the four-pronged support footage.

In use, the invalid person grasps (with his/her right hand) the lower most handle of the right-handed walking cane after having fallen accidentally to the ground or floor or after having fallen to the ground or floor due to a physical/mental incident and lifts himself/herself up a little from the ground. Then, the fallen invalid person grasps the mid-positioned handle with his/her left hand by raising himself/herself a little higher from the ground position. Finally, the invalid person grasps the customary upper handle with his/her right hand and lifts himself/herself to an upright or standing position to continue walking with his/her walking cane or call someone for further help if injured from the fall. The fallen invalid person can accomplish these physical actions provided that the walking cane is reachable by him/her after the fall to the ground in close proximity or by crawling to reach the walking cane if possible. A similar physical procedure is done by a left handed invalid person using a left handed walking cane except that the lowermost handle of the walking cane is first grasped by the right hand of the fallen invalid person to raise himself/herself a short distance from the ground, after which the fallen invalid person grasps the mid-handle of the walking cane with his/her left hand to raise himself/herself higher from the ground and finally the fallen invalid person grasps the customary upper handle of the walking cane to raise himself/herself in an upright position above the ground. These raising procedures by a fallen invalid person will become more visualized after a reading of the description of the preferred embodiments.

DESCRIPTION OF THE PREFERRED EMBODIMENTS

Figure 1:
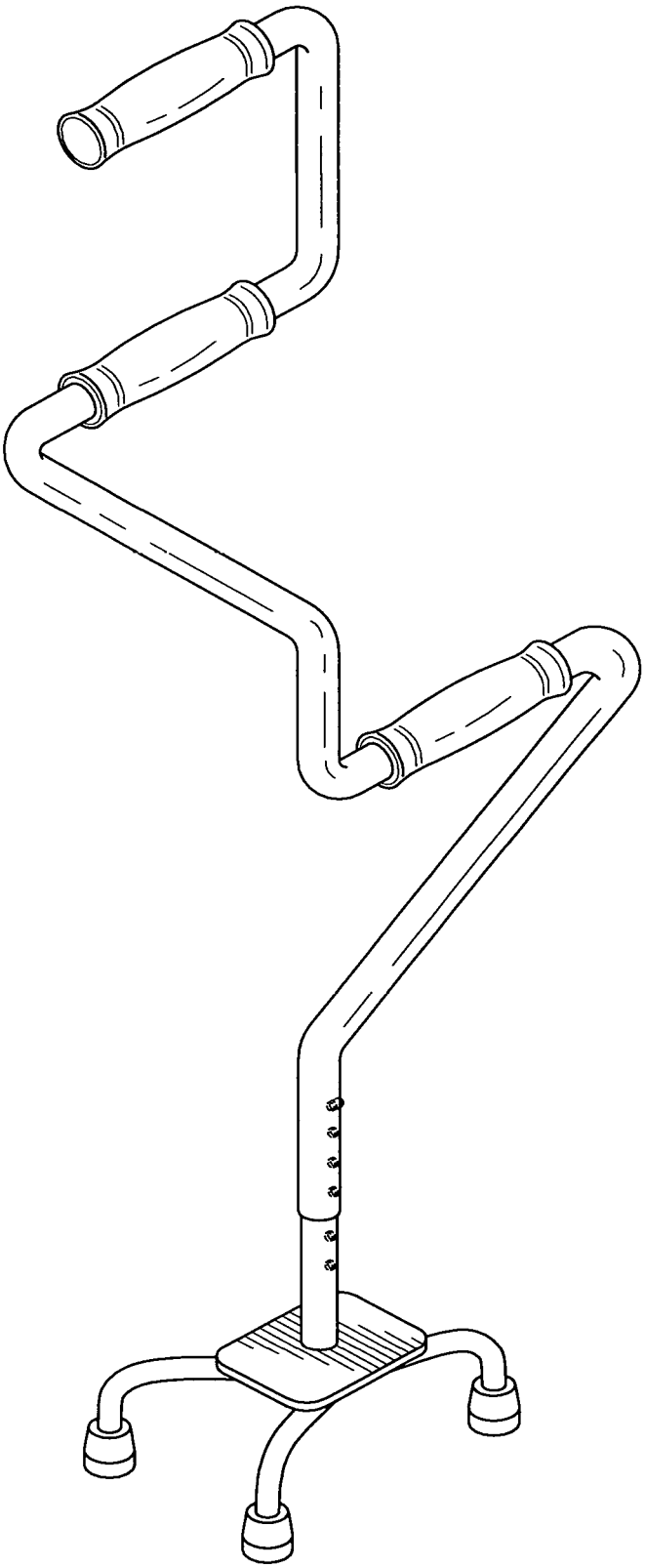
FIG. 1 is a perspective view of a first embodiment of the walking cane of this invention.
Figure 2:
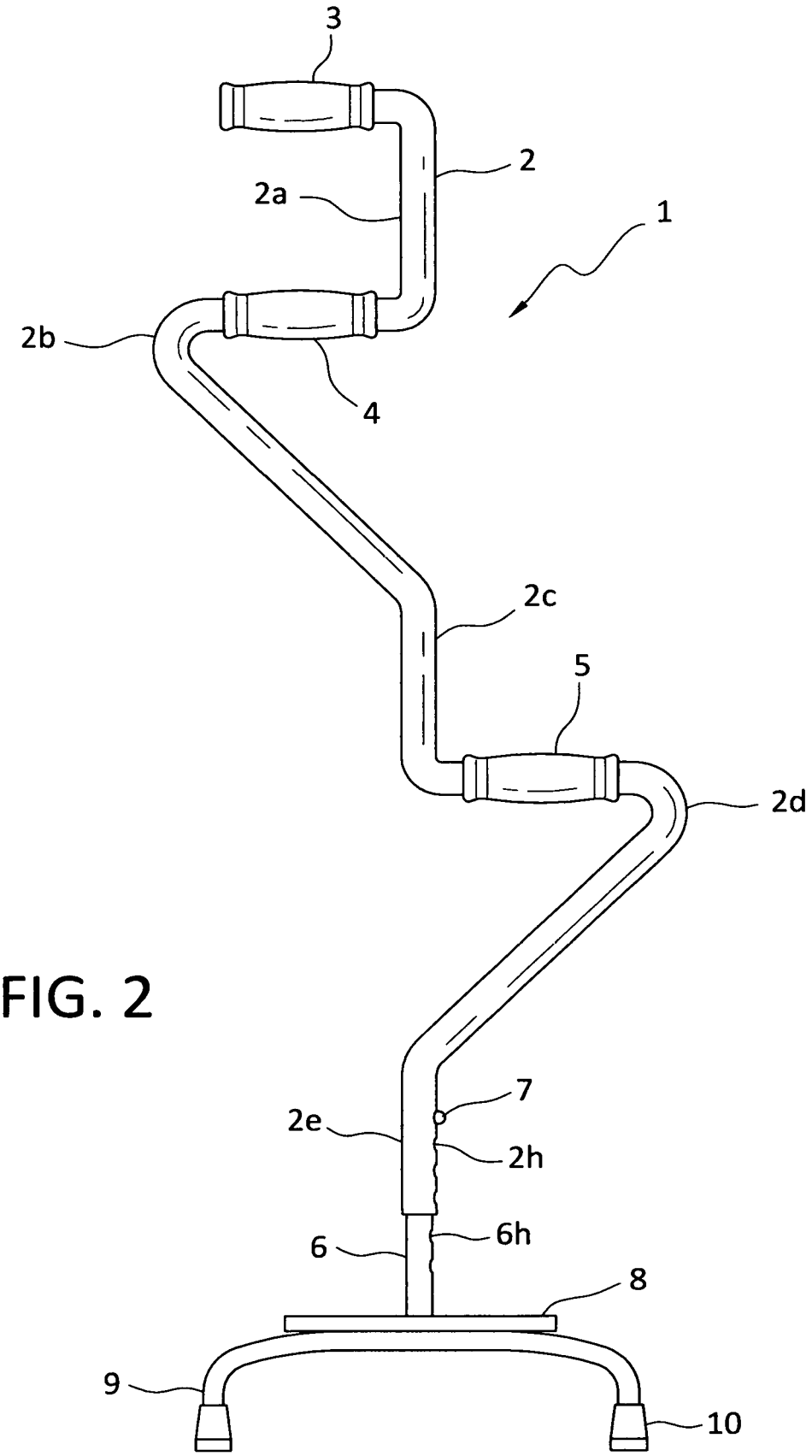
FIG. 2 is an elevational view of the first embodiment of the walking cane of this invention.

The first embodiment of this invention is a walking cane used by a right-handed invalid person as shown in FIG. 2 of the drawing. The walking cane 1 has a shaft 2 with an upper handle 3 at the top end of the shaft 2. The shaft 2 has a first straight section 2*a* joined below by a first curved (goose like) section 2*b* which extends to the left of section 2*a* of the shaft 2. The first curved section 2*b* has a second handle 4 for gripping by the right-handed invalid person. The first curved section 2*b* is joined below to a second straight section 2*c* of the shaft 2. The second straight section 2*c* is joined below to a second curved (goose like) section 2*d* which extends to the right of the shaft 2. The second curved section 2*d* has a third handle 5 for gripping by the right-handed invalid person. The second curved section 2*d* is joined below to a straight section 2*e* of the shaft 2 Each of the handles 3, 4 and 5 may be padded with rubber or plastic. The length of each handle 3, 4, and 5 is approximately 4% to 5 inches. The straight section 2*e* has a plurality of longitudinally spaced aligned holes 2*h*. An elongated straight tubular member 6 is telescopically inserted into the tubular straight aligned along section 2*e*. All three straight sections 2*d*, 2*c* and 2*e* are aligned along a straight imaginary vertical line passing through the centers of each straight section. Tubular member 6 also has a plurality of longitudinally spaced aligned holes 6*h* which are used to adjust the height or length of the walking cane 1 in conjunction with a spring-loaded push button 7 as disclosed in U.S. Pat. No. 4,065,115. The bottom end of the tubular member 6 is welded to the quad plate support 8 and the four tubular legs 9 are welded to the bottom side of the quad plate support 8. The cane 1 and its sections as well as the quad plate support 8 and four legs 9 are made from a sturdy metal such as aluminum or anodized aluminum. Each of the legs 9 are encapsulated with rubber tips 10. The walking cane shaft 2 is approximately 27" in length, the first straight section 2*a* is approximately 4 inches long, the straight sections 2*c* and 2*e* are each approximately 5-6 inches, the straight tubular section 6 is approximately 5-6 inches and the quad plate 8, which is rectangular in shape, is approximately 3 square inches. The overall height of the walking cane 1 varies from approximately 34 inches plus or minus 2 inches depending upon the height of the invalid person and, therefore, the positioning of the tubular member 6 within the tubular straight section 2*e*.

In the situation when the right-handed invalid person has fallen to the ground, he or she grasps the third handle 5 with his/her right hand and raises himself/herself slightly off the ground. Then the invalid person grasps the second handle 4 with his/her left hand and raises himself/herself higher from the ground. Finally, the invalid person grasps the upper handle 3 with his/her right hand and raises himself/herself to an erect or upright position so that he or she can continue walking or call someone for help, if needed, either by cell phone or by voice.

Figure 3:
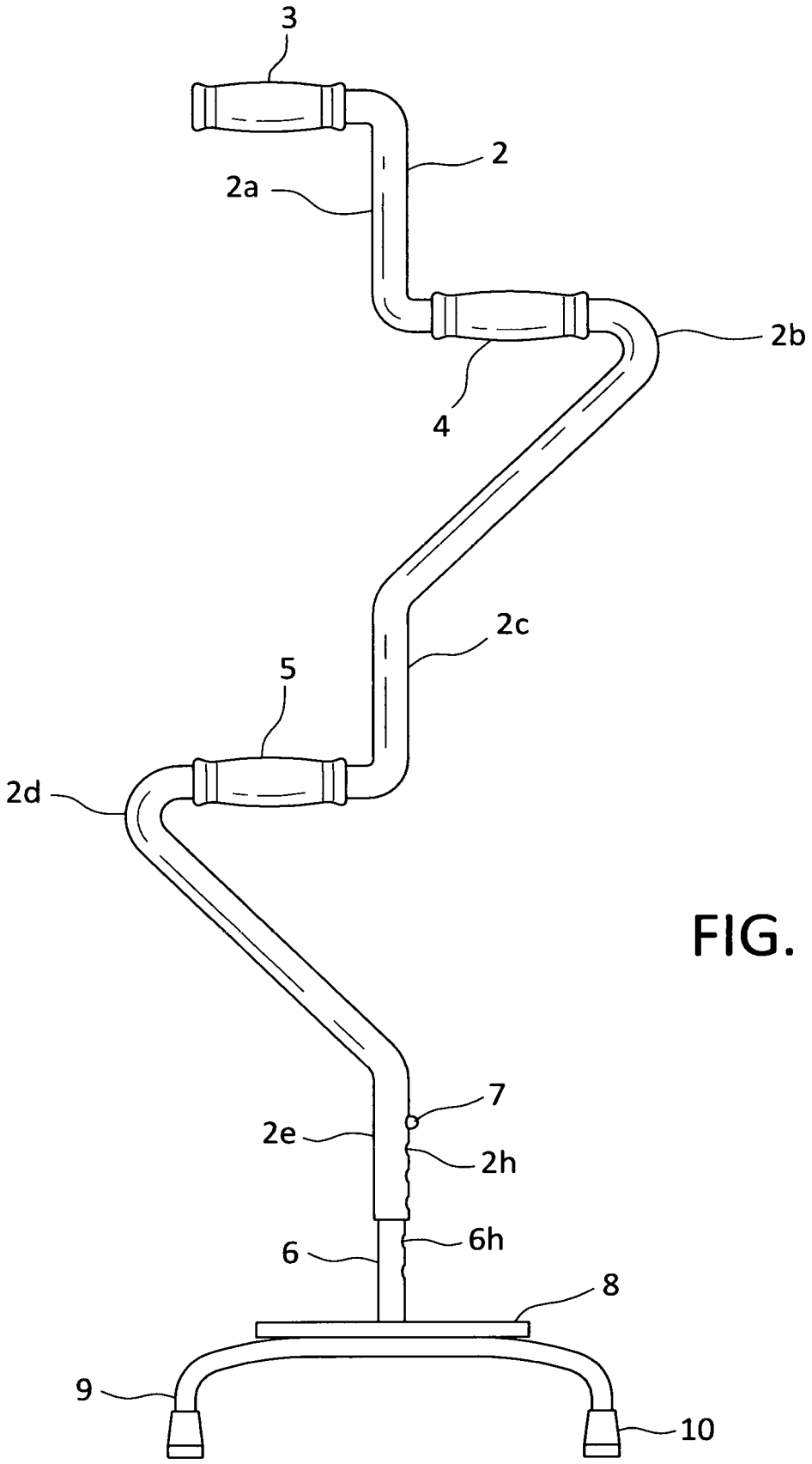
FIG. 3 is an elevational view of a second embodiment of the walking cane of this invention.

The second embodiment of this invention, as shown in FIG. 3 of the drawing, is a walking cane 1 for use by a left-handed invalid person. The second embodiment of this invention for a left-handed person is similar to that of the first embodiment for a right-handed person except that the first and second curved sections are oriented opposite to those in the first embodiment. The reference numbers in the second embodiment shown in FIG. 3 are the same as those shown in the FIG. 2 embodiment, In the situation when the left-handed invalid person has fallen to the ground, he or she grasps the third handle 5 with his/her left hand and raises himself/herself slightly off the ground. Then the left-handed invalid person grasps the second handle 4 with his/her right hand and raises himself/herself higher from the ground. Finally, the left-handed invalid person grasps the upper handle 3 with his/her left hand and raises himself/herself to an erect or upright position so that he or she can continue walking or call someone for help, if needed, either by cell phone or by voice.

Modification of this invention will be readily apparent to those skilled in the walking cane art and it is intended that the invention be not limited by the embodiments disclosed herein but that the scope of the invention be defined by the appended claims.

What is claimed is:

1. A walking cane for an invalid person comprising an elongated tubular shaft having an upper end and a bottom end, said upper end having a first handle extending to the left and horizontally from said upper end, a first curved extension extending from an upper portion of said elongated shaft, said first curved extension having a second handle horizontally oriented with respect to said elongated shaft, a second curved extension positioned below said first curved extension and spaced from said bottom end of said shaft and said first curved extension, said second curved extension being oriented opposite to said first curved section and said second curved extension having a third handle horizontally oriented with respect to said elongated shaft, a tubular member upper end telescopically inserted into the bottom end of said elongated tubular shaft, each of said elongated tubular shaft and tubular member upper end having a plurality of holes therein to adjust the operable length of said walking cane and said tubular member being fixedly attached to a four-pronged footage at a bottom end of the tubular member.

2. A walking cane as recited in claim 1 wherein said first and second curved extensions have substantially the same configuration and are substantially the same size.

3. A walking cane as recited in claim 2 wherein said first and second curved extensions have a substantially goose-neck configuration.

4. A walking cane as recited in claim 1 wherein each of said handles is padded for comfort to said invalid person when grasped by said invalid person.

5. A walking cane as recited in claim 4 wherein said holes in the bottom portion of said elongated tubular shaft are receptive to a spring-loaded pushbutton for adjusting the height of said walking cane.

6. A walking cane as recited in claim 1 wherein said elongated tubular shaft, said bottom tubular member and said four-pronged footage and are made from a sturdy metal.

7. A walking cane as recited in claim 6 wherein said metal is aluminum or anodized aluminum.

8. A walking cane as recited in claim 6 wherein said four-pronged footage has four legs with rubber tips.

9. A walking cane as recited in claim 1 wherein said first, second and third handles are padded with plastic or foam rubber.

10. A walking cane as recited in claim 1 wherein said elongated tubular shaft has an imaginary straight line extending from its upper end to its bottom end whereby said first and second extensions are aligned therefrom.

11. A walking cane as recited in claim 1 wherein said second handle is spaced from said first handle by approximately 4 inches.

12. A walking cane as recited in claim 1 wherein each of said first, second and third handles has approximately the same length.

13. A walking cane as recited in claim 1 wherein the invalid person is right-handed, said first curved extension being oriented to the left of said elongated tubular shaft and said second curved extension being oriented to the right of said elongated tubular shaft.

14. A walking cane as recited in claim 1 wherein the invalid person is left-handed, said first curved extension being oriented to the right of said elongated tubular shaft and said second curved extension being oriented to the left of said elongated tubular shaft.

15. A walking cane as recited in claim 1 wherein said elongated tubular shaft has a first straight section between said first handle and said first curved extension, a second straight section between said first curved extension and said second curved extension, a third straight section between an end of said second curved extension and an end of said bottom end of said tubular shaft and wherein all three straight sections are aligned along an imaginary straight vertical line passing through the centers of each straight section.

16. A walking can as recited in claim 1 wherein each handle is approximately 4¾ to 5 inches in length.

* * * * *